US006793745B2

(12) United States Patent
Weber et al.

(10) Patent No.: US 6,793,745 B2
(45) Date of Patent: Sep. 21, 2004

(54) MARAGING TYPE SPRING STEEL

(75) Inventors: Hartwin Weber, Hanau (DE); Waldemar Doering, Hasselroth (DE); Gernot Hausch, Langenselbold (DE)

(73) Assignee: Vacuumschmelze GmbH & Co. KG (DE)

( * ) Notice: Subject to any disclaimer, the term of this patent is extended or adjusted under 35 U.S.C. 154(b) by 58 days.

(21) Appl. No.: 10/168,228

(22) PCT Filed: Jan. 17, 2001

(86) PCT No.: PCT/EP01/00498

§ 371 (c)(1),
(2), (4) Date: Sep. 16, 2002

(87) PCT Pub. No.: WO01/53556

PCT Pub. Date: Jul. 26, 2001

(65) Prior Publication Data

US 2003/0091458 A1 May 15, 2003

(30) Foreign Application Priority Data

Jan. 17, 2000 (DE) ..... 100 01 650

(51) Int. Cl.[7] ..... C22C 38/50; C21D 8/00; C21D 9/02

(52) U.S. Cl. ..... 148/330; 148/909; 148/325; 148/580; 148/547; 148/651

(58) Field of Search ..... 148/909, 330, 148/325, 327, 580, 547, 651

(56) References Cited

FOREIGN PATENT DOCUMENTS

| | | | | |
|---|---|---|---|---|
| DE | 19606817 | * | 5/1997 | ..... C22C/38/08 |
| EP | 0773307 | | 5/1997 | |

OTHER PUBLICATIONS

Japanese Patent Abstract 49119814, Nov. 15, 1974.
Japanese Patent Abstract 08074004, Mar. 19, 1996.

* cited by examiner

*Primary Examiner*—Deborah Yee
(74) *Attorney, Agent, or Firm*—Dean W. Russell; Kilpatrick Stockton LLP

(57) ABSTRACT

The invention relates to a high-strength, age-hardenable, corrosion-resistant maraging type spring steel, which is essentially comprised of 6.0 to 9.0 wt. % of Ni, 11.0 to 15.0 wt. % of Cr, 0.1 to 0.3 wt. % of Ti, 0.2 to 0.3 wt. % of Be and of a remainder consisting of Fe, whose martensite temperature $M_s \geqq 130°$ C. and which has a ferrite content $c_{ferrite}$ of less than 3%.

11 Claims, 5 Drawing Sheets

Schaeffler Diagram (Structure of Welding Fillers Based on Fe-Ni-Cr)

Schaeffler Diagram (Structure of Welding Fillers Based on Fe-Ni-Cr)

MARAGING TYPE SPRING STEEL

This application claims priority to German Application No. 100 01 650.2 flied on Jan. 17, 2000 and International Application No. PCT/EP01/00498 filed on Jan. 17, 2001, the entire contents of which are incorporated herein by reference.

DESCRIPTION

The invention relates to a high-strength, age-hardenable, corrosion-resistant maraging type spring steel.

Alloys which are fully martensitic in the solution-annealed state are used which are age-hardenable by heat treatment. These alloys exhibit good isotropic deformability prior to age-hardening. After age-hardening, these alloys display very high strength, hardness, fatigue strength under reversed bending stress, and relaxation resistance<300° C. Such alloys are known, for example, from European Patent Application 0 773 307 A1 and from Japanese Patent Application A-49 119 814.

These maraging type spring steels are distinguished from metastable austenitic or semi-austenitic steels primarily by their martensite temperature. For metastable austenitic or semi-austenitic spring steels, the martensite temperature is approximately at or below room temperature. Such metastable austenitic or semi-austenitic steels are known from European Patent Application 0 210 035 A1, for example.

The aforementioned steels require increased cold forming in order to form strain-induced martensite. They have the distinct disadvantage that in the production of wires and strips, the ductility is severely reduced by the increased cold forming before the actual age-hardening. In particular for the production of strips, a so-called deformation texture forms which prevents isotropic deformability. Here and in the following discussion, "isotropic deformability" is understood to mean that the deformability is comparable both parallel and perpendicular to the direction of rolling.

However, in the use of spring steels for spring elements, which must fulfill a plurality of functions simultaneously, such isotropic deformability is absolutely essential.

A high-strength, corrosion-resistant spring steel is known from the previously mentioned Japanese Patent Application A-49 119 814 which comprises nickel and chromium in the range (2.5; 14), (10.2; 14), (7.3; 18), and (2.5; 18) on the (nickel; chromium) weight-% diagram, with the remainder comprising iron. For heat treatment, Japanese Patent Application A-49 119 815 recommends at least one of the elements molybdenum, titanium, copper, tungsten, or zircon in a total proportion of less than 0.5% by weight. For age-hardening, a beryllium content greater than 0.3% by weight is recommended. It has been shown that when a beryllium content greater than 0.3% by weight is used, even when the titanium additives of the teaching are also used, the alloy could not be heat treated.

A high-strength, corrosion-resistant spring steel is known from the previously mentioned European Patent Application 773 307 A1 which comprises 6 to 9% by weight nickel, 11 to 15% by weight chromium, 0 to 6% by weight copper and cobalt, and a combination of molybdenum+½ tungsten in the range of 0.5 to 6% by weight and beryllium in the range of 0.1 to 0.5% by weight. However, in this case it has been shown that this material is not effective in production because in some cases it is dual-phase; that is, in addition to martensite it also contains high proportions of ferrite. However, this proportion of ferrite results in undesired mechanical properties. On the one hand, proportions of ferrite in the aforementioned compositions can rise as high as 60%, resulting in reduced lattice distortion and thus loss of hardness before and after age-hardening. On the other hand, during heat treating in the unfavorable temperature range between age-hardening and solution annealing, the ferrite can decompose into a brittle theta phase which upon cooling converts to martensite. This decomposition results in greatly decreased ductility.

Furthermore, in the aforementioned compositions the martensite temperature in some cases is too low, for example, −40° C. And, even for compositions with martensite temperatures that under normal conditions are approximately 100° C., in some cases it is possible that the austenite is not completely converted to martensite. The temperature and duration of annealing in addition to the quenching speed have been found to be critical processing parameters. This results in sharp declines in hardness in the age-hardened state and marked fluctuations in quality during production.

In addition, spring alloys are known from Swiss Patent 320 815 which can comprise up to 25% by weight chromium and up to 20% by weight nickel. The alloys described therein may be austensitic as well as ferritic or martensitic, and may also be present in combinations of austensite, ferrite, and martensite. As a rule, with the wide alloy windows described therein, the mechanical properties, in particular a good, reproducible isotropic deformability, cannot be assured.

Furthermore, an austensitic superalloy based on cobalt-nickel is known from Swiss Patent 265 255. The cobalt-nickel-based alloy described therein is provided with hardening additives of beryllium and/or titanium and/or carbon in quantities of up to 5% by weight. The alloys described therein are austensitic, with the result that fairly high beryllium concentrations are necessary to age-harden them since the solubility of beryllium in an austensitic structure is relatively high.

In addition, a method for adjusting textures in ferritic alloys is known from German Laid-Open Patent Specification AS 1 186 889.

The object of the present invention, therefore, is to prepare a high-strength, age-hardenable, corrosion-resistant maraging type spring steel that is easy to produce, thus assuring that there are no fluctuations in quality of the manufactured steels.

The object of the invention is achieved by a high-strength, age-hardenable, corrosion-resistant maraging type spring steel which is characterized in that the spring steel essentially comprises

| | |
|---|---|
| 6.0 to 9.0% by weight Ni | 0.1 to 0.3% by weight Ti |
| 11.0 to 15.0% by weight Cr | 0.2 to 0.3% by weight Be |

and the remainder Fe, that the spring steel has a martensite temperature $M_s$>130° C., and that the ferrite content of the spring steel $c_{ferrite}$<3%.

Figure 6:
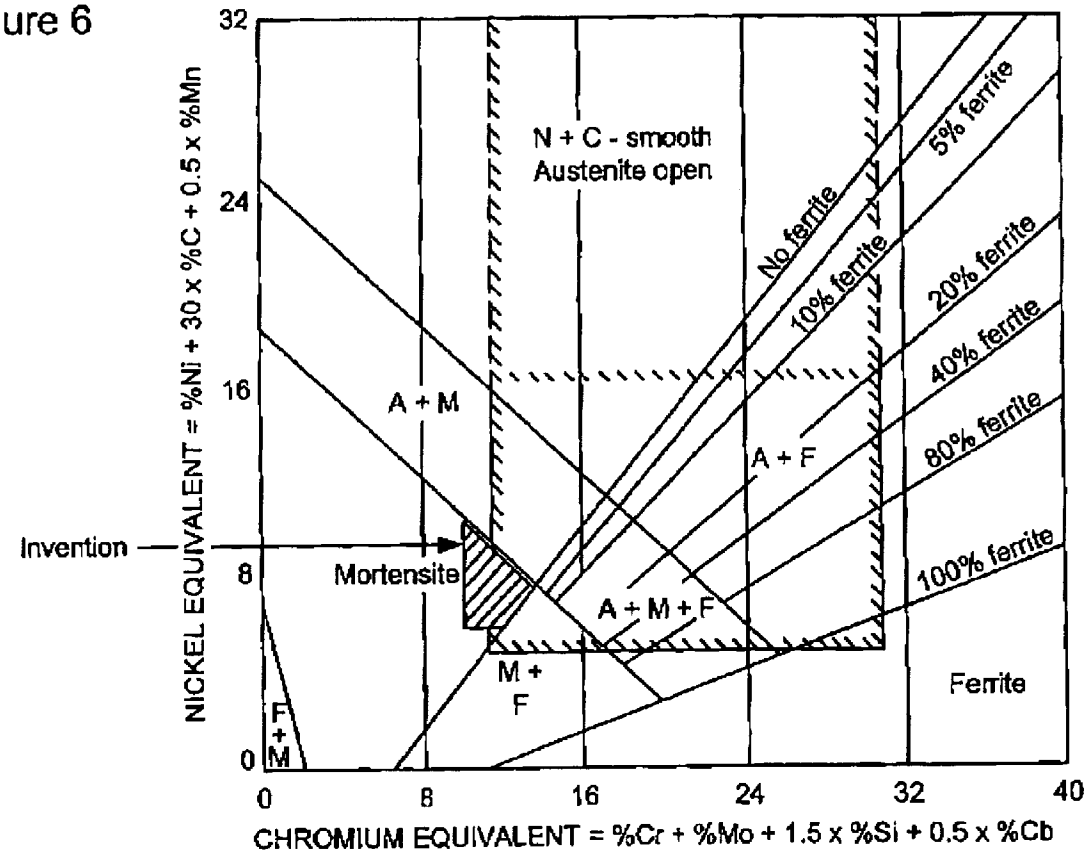
FIG. 6 illustrates an assortment of alloys according to the invention in a so-called "Schaeffler" diagram.

FIG. 6 illustrates this assortment of alloys according to the invention in a so-called "Schaeffler" diagram.

Typically, up to 50% of the nickel content can be replaced by cobalt, and up to 35% of the chromium content can be replaced by molybdenum and/or tungsten.

In a refinement of the present invention, the spring steel can comprise up to 4% by weight copper to increase the corrosion resistance even further, in particular against pitting.

The spring steel can comprise at least one of the elements manganese, silicon, aluminum, or niobium in individual proportions of less than 0.5% by weight.

To achieve a qualitatively high-quality spring steel, the spring steel according to the invention comprises at least one of the elements carbon, nitrogen, sulfur, phosphorus, boron, hydrogen, or oxygen in individual proportions of less than 0.1% by weight. If these proportions are exceeded, undesired carbide, boride, or nitride precipitates result which have a negative effect on the physical properties of the material.

In a preferred embodiment, the spring steel comprises up to 0.1% by weight cerium or cerium misch metal as a deoxidizing agent.

To correctly adjust the components for the alloy melt, it has been found that the martensite temperature, which must be above 130° C. according to the present invention, can be represented by equation (1):

$$M_s=[629.45-16.8(Cr+1.2\ Mo+0.6\ W)-24.5(Ni+0.15\ Co)-13.2\ Mn-11.2\ Si-670(C+N)]^\circ C. \quad (1)$$

The proportion of ferrite can be adjusted in percent by weight according to equation (2):

$$c_{ferrite}=[11.8\ Si+7.92(Cr+Mo+\tfrac{1}{2}\ W)+15.84\ \mathrm{Ti}-2.91\ Mn-5.83(Ni+0.3\ Co)-174.9(C+N)-77.08] \quad (2)$$

According to the invention, the ferrite content must not exceed 3%, or otherwise brittle theta phases or great losses in hardness may result.

Figure 1:
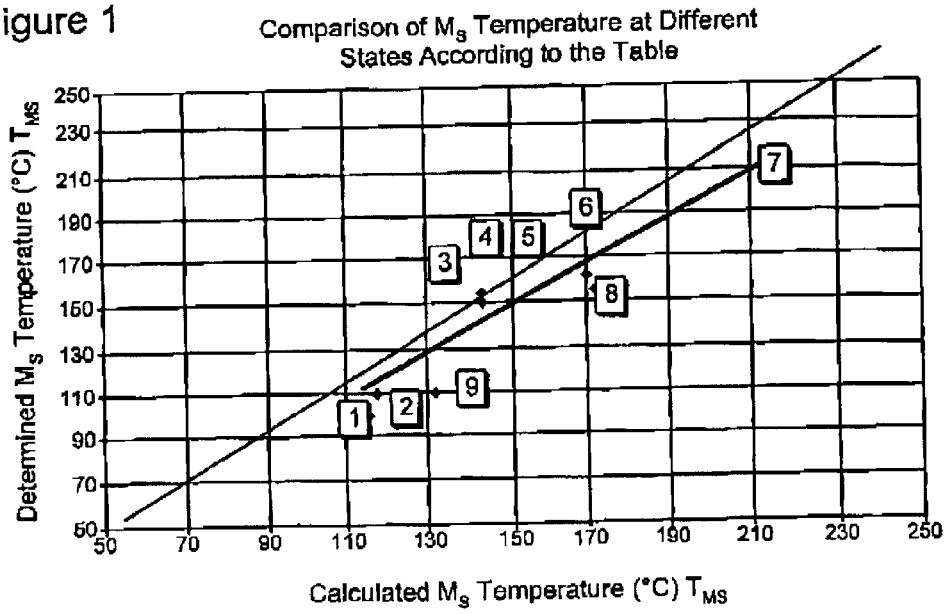
FIGS. 1 and 2 show a comparison of certain calculated and determined values for martensite temperature and ferrite content.
Figure 2:
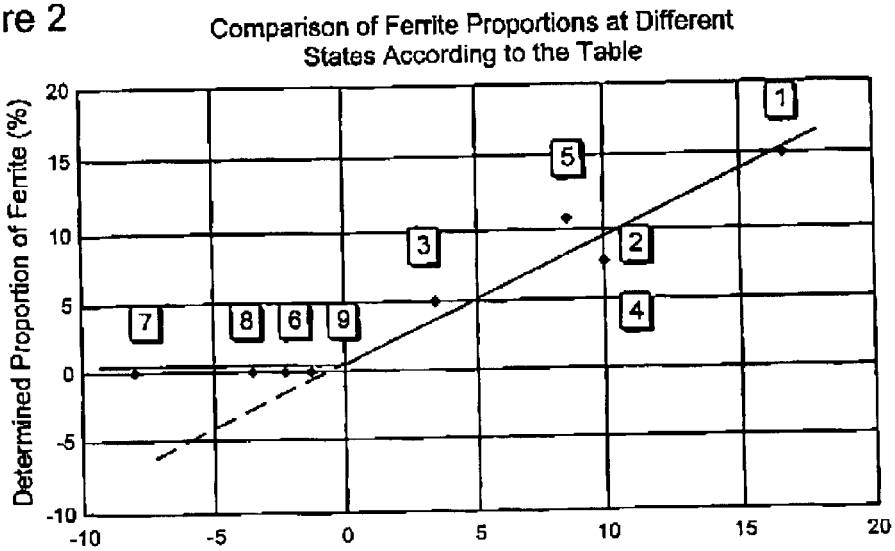

FIGS. 1 and 2 show a comparison of the calculated values with the determined values for the martensite temperature and the ferrite content. The compositions of the alloys shown in FIGS. 1 and 2 are presented in the following table.

| | Elemente | | | | | | | | | | | Proportion of ferrite (%) Ferrit- | Vickers hardness after age-hardening |
|---|---|---|---|---|---|---|---|---|---|---|---|---|---|
| Nr. | Fe | Ni | Cr | Mo | Be | Si | Mn | Ti | N | C | Ms-T (° C.) | Anteil (%) | HV n. Aush. |
| | Remainder | | | | | | | | | | | | |
| 1 | Rest | 7.75 | 12.20 | 5.00 | 0.25 | 0.08 | 0.22 | 0.27 | | | 114 | 15 | 640 |
| 2 | Rest | 7.80 | 12.20 | 5.00 | 0.17 | 0.08 | 0.20 | 0.15 | | | 117 | 8 | 595 |
| 3 | Rest | 7.00 | 11.60 | 5.00 | 0.24 | 0.08 | 0.21 | 0.30 | | | 142 | 5 | 640 |
| 4 | Rest | 7.75 | 11.00 | 4.50 | 0.25 | 0.08 | 0.20 | 0.29 | | | 143 | 5 | 640 |
| 5 | Rest | 7.40 | 11.60 | 4.60 | 0.25 | 0.08 | 0.19 | 0.29 | | | 143 | 11 | 640 |
| 6 | Rest | 7.80 | 12.20 | 2.00 | 0.25 | 0.08 | 0.20 | 0.25 | | | 170 | 0 | 640 |
| 7 | Rest | 7.80 | 12.20 | 0.00 | 0.25 | 0.08 | 0.20 | 0.25 | | | 214 | 0 | 640 |
| 8 | Rest | 7.80 | 13.65 | 1.15 | 0.19 | 0.19 | 0.29 | 0.19 | | | 172 | 0 | 640 |
| 9 | Rest | 7.80 | 13.95 | 1.35 | 0.20 | 0.38 | 0.47 | 0.29 | 0.024 | 0.020 | 132 | 0 | 640 |

The alloy compositions shown in FIGS. 1 and 2 all attain a Vickers hardness greater than 590 after two hours of heat treatment at 470° C.

The present alloys are typically produced by casting a melt in a crucible or oven under vacuum, or under a protective gas atmosphere. The melt temperatures are approximately 1500° C. The melt is then poured into a mold. The ingots from the present alloys are then bloomed at a temperature of approximately 1000° C. to 1200° C., and are then hot formed into a strip at 900° C.$\leqq T_1 \leqq$1150° C. Low heat rolling temperatures are chosen to minimize the edge zones depleted of free Be. Then a first solution annealing (homogenization) of the strip takes place at 850° C.$\leqq T_2 \leqq$1100° C., depending on the choice of annealing time. After cooling the strip to a temperature $T_3 \leqq$300° C., the strip is cold formed and ground at a temperature corresponding approximately to room temperature, the intent being to completely remove the edge zone depleted of free Be. A second solution annealing then takes place at 850° C.$\leqq T_5 \leqq$1100° C. with the goal of obtaining a fine-grained austenite structure.

In a first embodiment of the present invention, after the second solution annealing a heat treatment of the strip takes place at 400° C.$\leqq T_6 \leqq$550° C. The heat treatment is carried out for 0.25 to 10 hours. The solution annealing can last from 1 minute to 6 hours, and slow cooling or sudden quenching may be performed; that is, the quenching speed has a relatively small influence.

In an alternative embodiment of the present invention, to obtain greater hardness after the second solution annealing a second cold forming takes place at a temperature corresponding approximately to room temperature. The isotropic deformability here is not greatly affected due to the low solidification and texture formation of the maraging alloys used here. The heat treatment at 400° C.$\leqq T_6 \leqq$550° C. follows only after the second cold forming.

Using the method according to the invention, spring elements were produced with Vickers hardnesses>590 and very high strengths (greater than 1900 N/mm$^2$).

The corrosion resistance was investigated in the age-hardened state by means of the moisture test and salt-spray test. No corrosive attack was determined after 28 days at 50° C. and a relative humidity of 90%. Likewise, no corrosive attack was determined after one day of salt spray on the spring elements.

The production of spring steel according to the invention is described in detail, with reference to the following preferred exemplary embodiment:

Exemplary Embodiment

An alloy comprising 7.8% by weight Ni, 13.0% by weight Cr, 1.0% by weight Mo, 0.2% by weight Si, 0.3% by weight Mn, 0.25% by weight Be, 0.2% by weight Ti, with the remainder Fe, was melted under vacuum and poured into a circular mold at a temperature of approximately 1500° C.

The casting was bloomed at a temperature of approximately 1200° C. and then rolled into a strip at a temperature of approximately 1100° C. The martensite temperature $M_s$ of the melted alloy was approximately 156° C. The ferrite content $c_{ferrite}$ was zero.

After solution annealing at approximately 1000° C., the material was then cold rolled at room temperature and subjected to a second solution annealing, again at 1000° C., then cold formed again at room temperature.

Figure 3:
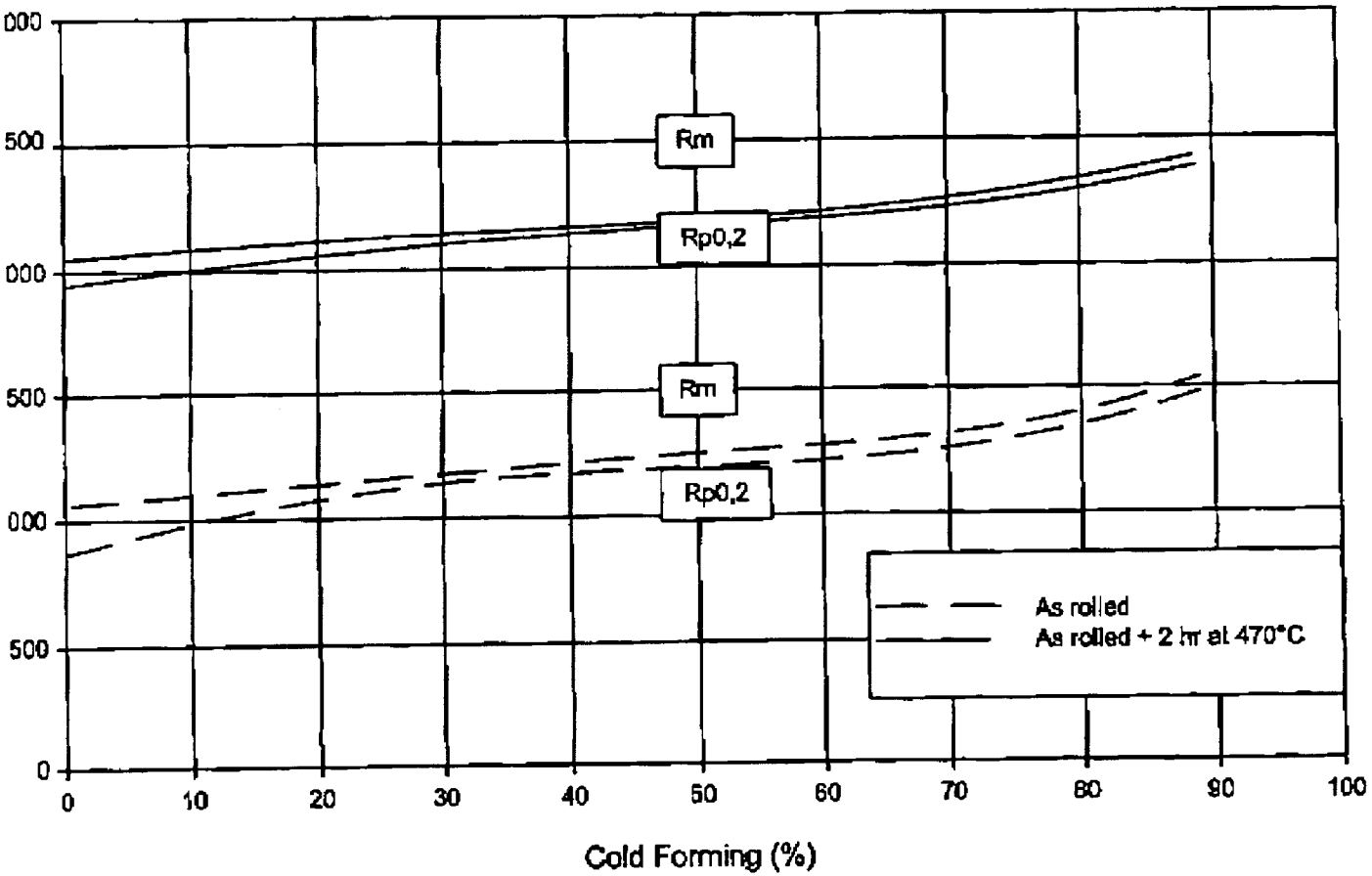
FIGS. 3 and 4 show information about certain mechanical properties as a function of the cold forming of certain alloys before and after age-hardening.
Figure 4:
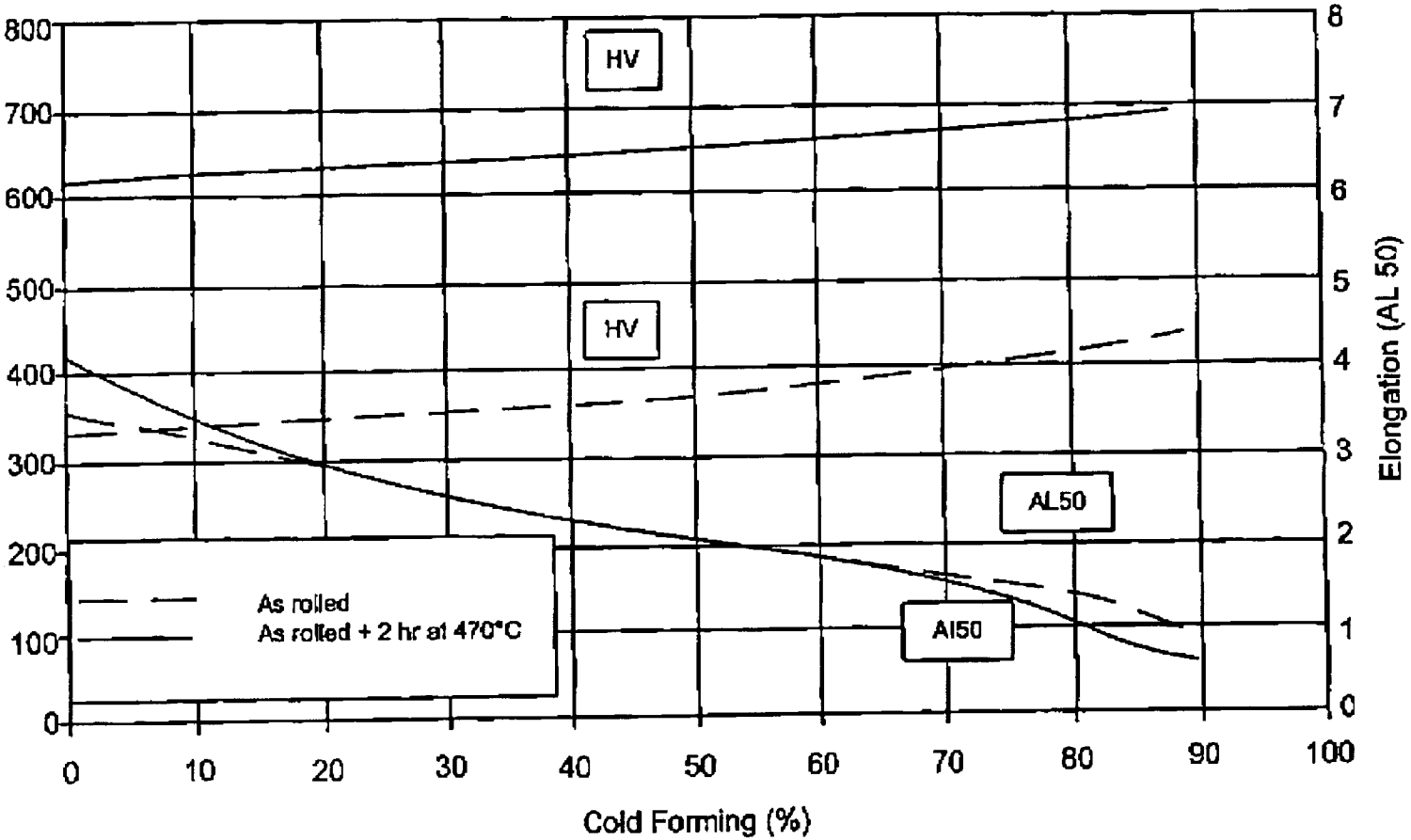

FIGS. 3 and 4 show the mechanical properties as a function of the cold forming of the alloy thus treated before and after age-hardening, which was carried out by heat treatment.

For these weakly solidifying alloys, the elongation is a poor measure of the ductility. The bending radii before age-hardening are better indicators.

Figure 5:
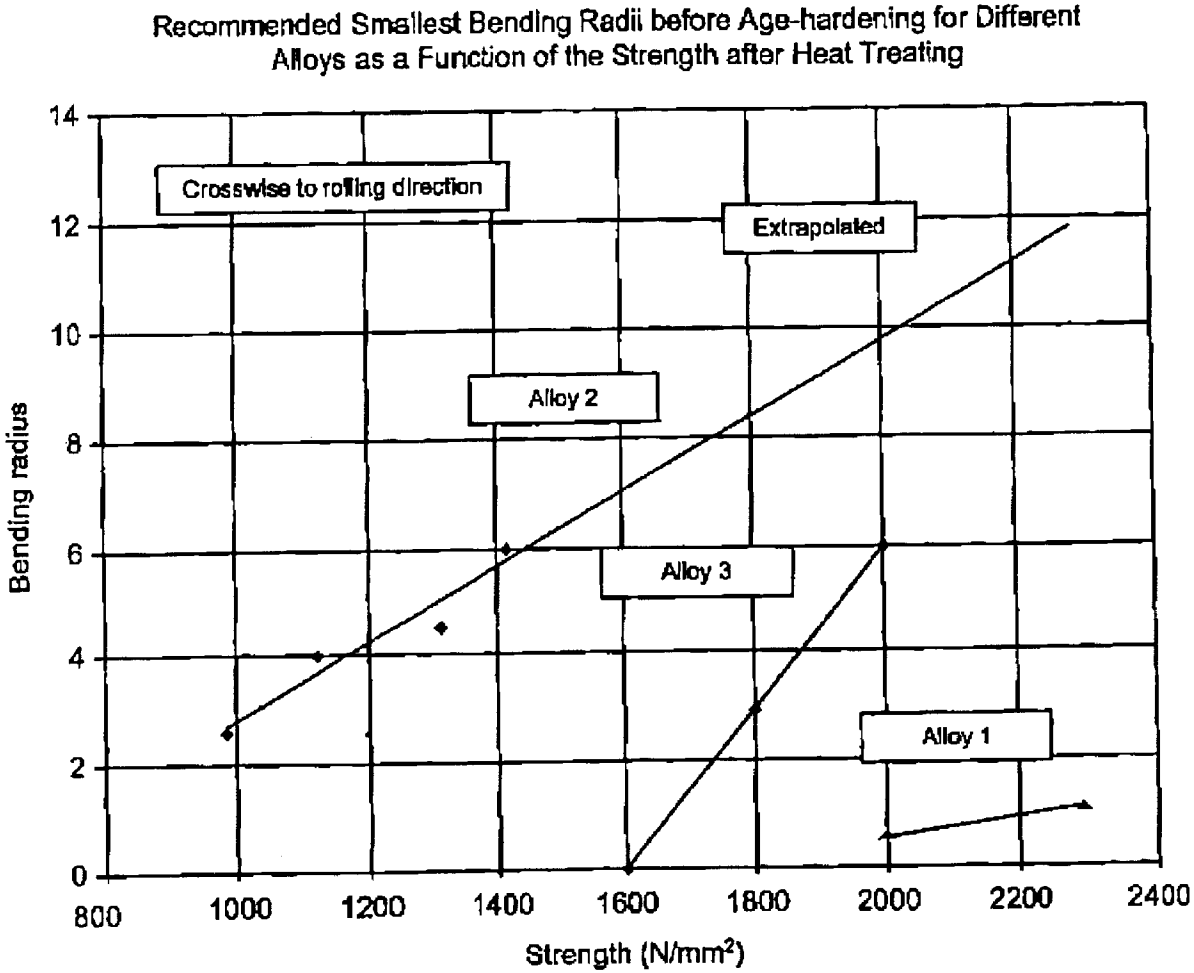
FIG. 5 shows information about bending radii before age-hardening for different alloys as a function of strength after heat treating.

The values obtained for the "difficult" direction, that is, with the neutral axis parallel to the rolling direction, are shown in FIG. 5, and are also associated with the strength after age-hardening and compared with two alloys from the prior art. The alloy according to the invention is designated here by reference number 1, and the two alloys from the prior art are designated by reference numbers 2 and 3. Alloy 2 from the prior art is a 1.4310 stainless steel (X12 Cr Ni 17 7) of the metastable austenite type. Alloy 3 is the austenitic spring material Ni2Be, which is marketed by Vacuumschmelze GmbH under the trade name Beryvac 520.

The bending radii in the "simple" direction, that is, with the neutral axis perpendicular to the rolling direction, have values that are at least equivalent or better.

FIG. 5 clearly shows that the maraging type spring steel according to the present invention is superior to the previously mentioned metastable austenitic or semi-austenitic spring steels.

Subsequent age-hardening is carried out by heat treatment for two hours at a temperature of 470° C.

What is claimed is:

1. A high-strength, age-hardenable, corrosion-resistant maraging spring steel having isotropic deformability wherein—the spring steel essentially comprises the spring steel essentially comprises

| | |
|---|---|
| 6.0 to 9.0% by weight Ni | 0.1 to 0.3% by weight Ti |
| 11.0 to 15.0% by weight Cr | 0.2 to 0.3% by weight Be |

and the remainder Fe, the spring steel has a martensite temperature $M_s \geqq 130°$ C., and the ferrite content of the spring steel $c_{ferrite} \leqq 3\%$.

2. The spring steel according to claim 1 wherein up to 50% of the nickel content is replaced by cobalt.

3. The spring steel according to claim 1 wherein up to 35% of the chromium content is replaced by molybdenum and/or tungsten.

4. The spring steel according to claim 1 wherein the spring steel comprises up to 0.1% by weight cerium or cerium misch metal as a deoxidizing agent.

5. The spring steel according to claim 1 wherein the spring steel comprises up to 4% by weight copper.

6. The spring steel according to claim 1 wherein the spring steel comprises at least one of the elements manganese or silicon in individual proportions of less than 0.5% by weight.

7. The spring steel according to claim 1 wherein the spring steel comprises at least one of the elements C, N, S, P, B, H, or O in individual proportions of less than 0.1% by weight.

8. A method for producing an isotropically flexible spring steel having a composition according to claim 1 comprising the following process steps:

a) Melting the alloy under vacuum or protective gas followed by casting into an ingot;

b) Hot forming the ingot into a strip at 900° C.$\leqq T_1 \leqq$1150° C.;

c) Carrying out a first solution annealing of the strip at 850° C.$\leqq T_2 \leqq$1100° C.;

d) Cooling the strip to a temperature $T_3 \leqq 300°$ C.;

e) Cold forming and grinding the strip to remove the beryllium-depleted edge zone; and $f_1$) Carrying out a second solution annealing at 850° C.$\leqq T_5 \leqq$1100° C.

9. The method according to claim 8 comprising the following additional process step:

g) Heat treating the strip at 400° C.$\leqq T_6 \leqq$550° C.

10. The method according to claim 8 comprising the following additional process steps:

$f_2$) Carrying out a second cold forming;

g) Heat treating at 400° C.$\leqq T_6 \leqq$550° C.

11. A high-strength, age-hardenable, corrosion-resistant maraging spring steel having isotropic deformability and comprising:

6.0–9.0 wt % Ni or a combination of Ni and Co;

0.1–0.3 wt % Ti;

11.0–15.0 wt % Cr, Mo, or W or combinations thereof;

0.2–0.3 wt % Be;

0–4 wt % Cu;

0–0.1 wt % Ce or cerium misch metal;

0–0.5 wt % Mn or Si;

0–0.1 wt % C, N, S, P, B, H, or O or combinations thereof; and the remainder Fe; provided, however, that the spring steel have a martensite temperature of at least 130° C. and a ferrite content of less than three percent.

* * * * *